US005968207A

United States Patent [19]

Li

[11] Patent Number: 5,968,207

[45] Date of Patent: Oct. 19, 1999

[54] ESTERIFIED TRICLOSAN DERIVATIVES AS IMPROVED TEXTILE ANTIMICROBIAL AGENTS

[75] Inventor: Shulong Li, Spartanburg, S.C.

[73] Assignee: Milliken & Company, Spartanburg, S.C.

[21] Appl. No.: 09/027,045

[22] Filed: Feb. 20, 1998

[51] Int. Cl.[6] ..... D06P 1/651; D06M 13/165

[52] U.S. Cl. ..... 8/490; 8/582; 8/609; 8/610; 8/614; 8/922; 8/924; 8/926; 8/115.64

[58] Field of Search ..... 8/490, 609, 610, 8/582, 614, 922, 924, 926, 115.56, 115.64

[56] References Cited

U.S. PATENT DOCUMENTS

| | | | |
|---|---|---|---|
| 3,353,151 | 11/1967 | Rockwell | 340/15.5 |
| 3,377,249 | 4/1968 | Marco | 8/115.6 |
| 3,506,720 | 4/1970 | Model et al. | 260/613 |
| 3,540,835 | 11/1970 | Marco | 8/115.6 |
| 3,563,795 | 2/1971 | Williams | 117/139.4 |
| 3,574,620 | 4/1971 | Tesoro | 117/62.1 |
| 3,598,641 | 8/1971 | Miller et al. | 117/138.8 E |
| 3,620,826 | 11/1971 | Machell | 117/139.5 C |
| 3,625,754 | 12/1971 | Dunn | 117/138.8 F |
| 3,632,420 | 1/1972 | Kuhn | 117/138.8 F |
| 3,649,165 | 3/1972 | Cotton | 8/115.5 |
| 3,650,801 | 3/1972 | Hinton, Jr. et al. | 117/47 A |
| 3,652,212 | 3/1972 | Machell | 8/115.5 |
| 3,660,010 | 5/1972 | Georgoudis et al. | 8/115.6 |
| 3,676,052 | 7/1972 | Harper, Jr. et al. | 8/115.6 |
| 3,690,942 | 9/1972 | Vandermass et al. | 117/138.8 F |
| 3,753,914 | 8/1973 | Berth et al. | 252/95 |
| 3,816,071 | 6/1974 | Dellian et al. . | |
| 3,897,206 | 7/1975 | Kearney | 8/120 |
| 3,904,696 | 9/1975 | Model et al. | 260/613 R |
| 3,929,903 | 12/1975 | Noguchi et al. | 260/613 R |
| 3,981,807 | 9/1976 | Raynolds | 252/8.8 |
| 3,981,905 | 9/1976 | Adams et al. | 260/473 R |
| 4,014,857 | 3/1977 | Schmoyer | 260/67.6 R |
| 4,068,035 | 1/1978 | Violland et al. | 428/279 |
| 4,073,993 | 2/1978 | Lark | 428/261 |
| 4,090,844 | 5/1978 | Rowland | 8/120 |
| 4,131,550 | 12/1978 | Marco | 252/8.6 |
| 4,164,392 | 8/1979 | Hauser et al. | 8/18 R |
| 4,168,954 | 9/1979 | Marco | 8/18 R |
| 4,207,071 | 6/1980 | Lipowitz et al. | 8/115.6 |
| 4,290,765 | 9/1981 | Sandler | 8/115.6 |
| 4,427,557 | 1/1984 | Stockburger | 252/8.7 |
| 4,937,277 | 6/1990 | O'Lenick, Jr. | 524/318 |

FOREIGN PATENT DOCUMENTS

| | | |
|---|---|---|
| 450347 | 4/1968 | Switzerland . |
| 459656 | 9/1968 | Switzerland . |

*Primary Examiner*—Margaret Einsmann
*Attorney, Agent, or Firm*—Terry T. Moyer; William S. Parks

[57] ABSTRACT

A process for imparting long-lasting antimicrobial properties to fabrics is disclosed which entails the diffusion of triclosan esters within each individual fiber of a textile. One preferred method is performed in a standard jet dye bath which requires a high range of temperatures to effectively color fabrics. Dyeing in this manner also involves diffusing compounds within individual fibers; thus, this manner of incorporating dyestuffs and colorants within textile fabrics provides a compatible and effective vehicle for simultaneously introducing triclosan esters within such textile fibers, also. A dye bath application is not required, however, as any procedure which allows contact between a triclosan ester derivative and a fabric at a sufficient temperature and for a sufficient time to effectuate diffusion of the ester within each individual fiber of the fabric is also contemplated within this invention. The inventive triclosan esters do not easily wash off and do not lose their antimicrobial characteristics upon contact with bleaching agents.

17 Claims, No Drawings

ESTERIFIED TRICLOSAN DERIVATIVES AS IMPROVED TEXTILE ANTIMICROBIAL AGENTS

FIELD OF THE INVENTION

This invention relates to fabrics comprised of individual fibers within which esterified triclosan has been diffused. This process imparts long-lasting durable antimicrobial, germicidal, and fungicidal properties to textiles which has heretofore not been achieved with triclosan alone.

DISCUSSION OF THE PRIOR ART

There has been a great deal of attention in recent years given to the hazards of antimicrobial contamination from potential everyday exposure. Noteworthy examples of such concern include the fatal consequences of food poisoning due to certain strains of *Eschericia coli* being found within undercooked beef in fast food restaurants; Salmonella contamination causing sicknesses from undercooked and unwashed poultry food products; and illnesses and skin infections attributed to *Staphylococcus aureus,* yeast, and other unicellular organisms. With such an increased consumer interest in this area, manufacturers have begun introducing antimicrobial agents, such as triclosan, available from Ciba-Geigy under the tradename Irgasan®, within various household products. For instance, certain brands of polypropylene cutting boards, liquid soaps, etc., all contain this very effective antimicrobial compound. Generally, the incorporation of triclosan within liquid or polymeric media has been relatively simple. However, there is a long-felt need to provide effective, durable, and long-lasting antimicrobial characteristics within textiles, in particular apparel fabrics, which is extremely difficult to accomplish with triclosan. There are commercially available textile products comprising acrylic and/or acetate fibers co-extruded with triclosan (for example Hoechst Celanese markets such acetate fabrics under the name Microsafe™ and Courtaulds markets such acrylic polymer fabrics under the name Amicor™). However, such an application is limited to those types of fibers; it does not work specifically for and within polyester, polyamide, cotton, lycra, etc., fabrics. Furthermore, this co-extrusion procedure is very expensive, particularly when compared to the inventive process.

Triclosan and its derivatives, as well as the antimicrobial properties possessed by such compounds, have been taught within U.S. Pat. Nos. 3,506,720 and 3,904,696, both to Model et al., U.S. Pat. No. 3,929,903, to Noguchi et al., and Swiss Patent 459,656, to Bindler et al., all U.S. Patents of which are herein entirely incorporated by reference. Textile surface treatments incorporating triclosan and triclosan derivatives have also been taught in order to impart temporary antimicrobial characteristics to apparel fabrics. Triclosan and its derivatives, and dispersions thereof, are favorable textile treatment agents most notably because of their low toxicity to skin, as well as their high levels of antimicrobial, germicidal, etc., activity. However, because of its high volatility at elevated temperatures and its high solubility within high pH aqueous media, triclosan tends to easily wash off a fabric substrate after very few laundry applications. Also, as noted above, chlorine bleach readily reacts with triclosan thereby decreasing its antimicrobial capabilities. Textile treatments incorporating triclosan and its derivatives, including some esterified products, are disclosed within U.S. Pat. No. 3,753,914, to Berth et al., and Swiss Patent 450,347, to Bindler. Neither of these patents teach nor fairly suggest a procedure whereby a triclosan ester is specifically diffused within individual fibers of a fabric, thereby providing long-lasting bactericidal, fungicidal, germicidal, etc., effects on the fabric substrate. The Swiss patent discusses impregnating a fabric; however, such a treatment is merely a surface application which fills the interstices between the yarns (as defined within the *Dictionary of Fiber & Textile Technology*). This difference between the prior art and the inventive process is particularly distinguishable since diffusion requires very high temperatures in order to fully effectuate the introduction of the triclosan within each individual fiber. Furthermore, the amounts of triclosan and triclosan derivatives applied to the fabrics within the teachings of this reference are much too low for durability within standard washing operations. Thus, there is no teaching or fair suggestion which provides for a long-lasting antimicrobial treatment for textile fabrics. As a result, there still remains a need within the fabric industry to provide an antimicrobial triclosan derivative application to fabrics which is durable, which is difficult to remove through standard washing techniques, which is not susceptible to antimicrobial degradation upon contact and reaction with chlorine bleaches, and which allows the triclosan base compound to retain substantially all of its antimicrobial properties throughout the entire fabric application.

DESCRIPTION OF THE INVENTION

It is thus an object of the invention to provide an improved, long-lasting antimicrobial finish for textile substrates. A further object of the invention is to provide a relatively inexpensive procedure during the manufacture and/or dyeing of fabrics for incorporating triclosan esters within individual textile fibers to impart durable and long-lasting germicidal, fungicidal, and antimicrobial properties to fabrics. Another object of the invention is to provide a fabric for the apparel industry which retains antimicrobial compounds therein through at least twenty-five laundry cycles (equivalent to one year with washing every other week). Yet another object of this invention is to provide an antimicrobial fabric for use in the food service industry, such as in table linens, napery, and the like, and not necessarily within apparel.

Accordingly, this invention concerns a method of imparting long-lasting antimicrobial properties to a fabric comprising the sequential steps of (a) providing at least one triclosan ester derivative; and (b) contacting said triclosan ester derivative with a textile at a temperature and for a period of time sufficient to effectuate the diffusion of said triclosan ester derivative within the individual fibers of said textile.

Furthermore, this invention also concerns a further more specific method of imparting long-lasting antimicrobial properties to a fabric comprising the sequential steps of (a) providing a triclosan ester derivative;

(b) introducing said triclosan ester derivative into a dye bath wherein said dye bath contains at least one textile dyestuff;

(c) introducing a textile into said dye bath;

(d) agitating said dye bath and raising the temperature of said dye bath to a temperature, under standard dye bath pressure, and for a period of time sufficient to effectuate diffusion of said triclosan ester derivative and said dyestuff within the individual fibers of said textile; and (e) removing the treated textile from said dye bath.

Nowhere within the prior art have such specific methods utilizing a triclosan ester derivative been disclosed or practiced. Preferably, prior to introduction within the dye bath, the triclosan ester is dispersed within an aqueous medium through addition of a surfactant, such as Triton™ X-301, manufactured by Union Carbide. The preferred dye bath is a component of a jet dye machine, such as a Hisaka jet dyeing machine.

Any ester derivative of triclosan is contemplated within this invention. Of particular preference, due to their ease of manufacture and their effectiveness in providing antimicrobial properties to a fabric are triclosan acetate, triclosan propionate, triclosan benzoate, triclosan-4-nitrobenzoate, and triclosan hexanoate. This list is merely one showing the preferred compounds of this invention and is not intended to limit its scope. Any standard dye, dyestuff, or colorant utilized within a textile jet dyeing process is also contemplated. The amount of dye or colorant may need to be adjusted from usual levels to compensate for the added triclosan ester derivative treatment. It is believed that the presence of triclosan ester, acted as a type of plasticizer within the dye bath, aids in diffusing the dye within the textile fibers in certain situations.

The textile substrate itself may be made from woven, non-woven, or knit fabric and made from any natural or man-made fiber. Examples of fibers include, but are not limited to, cotton, polyester, polyamide, ramie, acetate, polyolefin, acrylic, and lycra, or any blends thereof. Of these, polyester, polyamide, particularly nylon (-6 or -6,6), and lycra, and especially, blends of nylon and lycra are preferred. Also, the particularly preferred textiles are those which are knit. The durable, long-lasting, antimicrobial characteristics are most evident on these preferred textile substrates.

The process itself, as noted above, requires a sufficiently high temperature and duration of exposure to effectuate exhaustion and subsequent diffusion of the triclosan ester within the individual fibers of the textile substrate. The temperatures preferred in this process range from about 80°–130° C., with more specific temperatures depending on the particular ester derivative being exhausted and the particular textile fabric being treated. For instance, triclosan acetate diffuses well at a temperature of about 120° C. within fibers of knit polyester, as well as knit blends of nylon and lycra. If the temperature is too low, diffusion cannot take place. The period of time required generally ranges from about 10 to about 120 minutes, again depending on the ester derivative being diffused and the fabric being treated. Again, as merely an example, triclosan acetate required about 20 minutes at 120° C. to sufficiently diffuse within polyester knits and nylon/lycra blend knits.

The amount of triclosan ester derivative necessary to properly effectuate the desired long-lasting antimicrobial characteristics to a fabric is dependent on the amount of fabric actually being treated. Thus, the ratio of wt % between the weight of fabric and the weight of triclosan ester derivative within the dye bath should be from about 100:0.01 to about 100:1. Preferably, this range is from about 100:0.03 to about 100:0.6, and most preferably from about 100:0.1 to about 100:0.25.

Further types of specific procedures for introducing the ester within a fabric include heat setting, slashing, and any other process which may include sufficient heating and sufficient time for diffusion of the ester within the individual fibers of the treated fabric.

In actuality, the use of triclosan esters merely provides an effective manner of applying and diffusing triclosan itself within a fabric substrate. It is believed that the antimicrobial properties of a textile treated with triclosan ester are obtained from the triclosan compound itself which is very slowly generated by hydrolysis of the ester in an aqueous or moisture-containing environment. This method is thus highly effective at providing antimicrobial characteristics as well as providing a durable antimicrobial diffused fiber finish. Triclosan is illustrated by the following Figure (I):

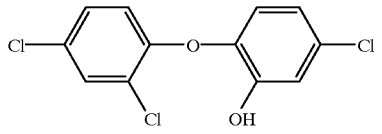

Such a compound, with a free hydroxyl group, is easily dissolved in water at high pH. Triclosan also has a tendency to volatilize at high temperatures.

The preferred ester derivatives, having esterified the hydroxyl group of the triclosan, are illustrated by the flowing Figure (II):

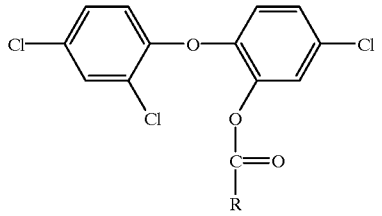

wherein R is selected from the group consisting essentially of $C_1$–$C_{10}$ alkyl or cycloalkyl, aryl, and substituted aryl. Specifically, the preferred compounds are triclosan acetate, triclosan propionate, triclosan benzoate, triclosan 4-nitrobenzoate, and triclosan hexanoate. Particularly preferred is triclosan acetate. In another embodiment, R is a phosphate group so as to form a triclosan phosphate ester. A compound defined by Figure (II) does not dissolve in water and generally has a much lower volatility than triclosan itself. For example, thermal gravimetric analyses of triclosan and the acetate thereof show this substantial difference in volatility, as shown in the TABLE below.

TABLE

Thermal Gravimetric Analysis
Measurements were obtained of the weight percent lost for the samples below using a Perkin-Elmer TGA 7 where the temperature was scanned from 40° to 250°at 20° C./minute. At the completion of the temperature scan for each, the following results were obtained:

| Sample | % Weight Loss |
|---|---|
| Triclosan | 62 |
| Triclosan Acetate | 12 |

The oleophilicity of this particular ester derivative facilitates exhaustion onto the hydrophobic fiber surfaces and further facilitates diffusion into each individual fiber. To the contrary, triclosan itself, with a free hydroxyl moiety, does not readily exhaust onto the fiber surfaces and cannot appreciably diffuse into the individual fibers in an aqueous dye bath. This ability to diffuse within individual fibers thus provides a manner in which only small, but antimicrobially effective, amounts of triclosan are formed on and within the fabric. Washing and bleaching, particularly with harsh chlorinated agents, do not affect the durability or antimicrobial characteristics of the esters. Generally, a surface treatment application, such as the mere coating or impregnation within the interstices of fabrics with triclosan esters or triclosan itself, can be easily removed by a high pH detergent solution within a laundry cycle, and thus would not provide a durable, long-lasting antimicrobial treatment for textiles. Triclosan esters diffused within the fibers of a fabric are not in contact with the washing liquid and therefore cannot be easily removed. However, the triclosan ester within the fiber has the ability to migrate to the fiber surface at a very slow rate in order to provide the antimicrobial effect on the substrate. One further important issue regarding the differences between triclosan and its ester derivatives is the fact that triclosan has been known to cause irritation to nervous system membranes when inhaled. Triclosan ester derivatives at this particular level of and in this manner of use do not present such a deleterious and potentially harmful problem. Due to the low, though antimicrobially effective, amount of triclosan formed upon hydrolysis of the ester while present on a fabric substrate, this problem is not of great concern. However, in order to possibly, if at all, effectuate a long-lasting antimicrobial finish to fabrics utilizing triclosan alone, the enormous amount of compound required would likely present a serious health hazard.

Any other standard textile additives, such as dyes, sizing compounds, ultra violet absorbers, and softening agents may also be incorporated within or introduced onto the surface of the treated fabric substrate. Particularly desired as optional finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture. The preferred soil release agents contemplated within this invention may be found in U.S. Pat. Nos. 3,377,249; 3,535,151; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference.

The treated fabric may be incorporated into a garment, a table linen, a bathroom linen, a napery linen, a bar towel, or any other type of fabric of which antimicrobial properties are desirous.

The triclosan esters of this invention can be produced by the method disclosed in Swiss Patent 450,347, supra, previously incorporated entirely by reference.

DESCRIPTION OF THE PREFERRED EMBODIMENT

The following examples are indicative of the preferred embodiments of the method of utilizing and applying this invention:

EXAMPLE 1

Application of Triclosan Ester By Diffusion

Equal amounts of triclosan acetate (2,4,4'-trichloro-2'-acetoxy-diphenyl ether) and Triton™ X-301 were introduced into a flask under stirring. Upon addition of 50 wt % water to the mixture, a stable dispersion of triclosan acetate was obtained at a content of 50 wt %. The dispersion was then introduced within a Hisaka jet dyeing machine. A 50/50 nylon/lycra blend knit fabric was then added to the machine such that the wt % ratio of fabric to ester was 100:0.1. The machine was then closed, agitated, heated to a temperature of about 120° C. for about 20 minutes, then allowed to cool to room temperature. At that time the fabric was removed from the machine, dried, and analyzed for its antimicrobial properties. Utilizing AATCC Test Method 147-1993, the fabric showed 100% contact inhibition and a 3 mm zone of inhibition when tested against *Staphylococcus aureus*. The fabric was then subjected to an equivalent of 25 standard home washes and subsequently tested for the same contact inhibition and zone of inhibition. After 25 washes, the fabric retained the same level of contact inhibition and showed a 1 mm zone of inhibition against *Staphylococcus aureus*.

EXAMPLE 2

Application of Triclosan Ester By Diffusion

The same procedure was used as in EXAMPLE 1 except that the fabric treated was a 100% polyester knit fabric of 0.70 denier per filament yarn having a weight of 6 oz/yd$^2$ and the wt % ratio of fabric to ester was 100:0.25. Again, the same results for contact inhibition and zone of inhibition were obtained after 0 washes and after 25 washes as tested against *Staphylococcus aureus*.

EXAMPLE 3 (COMPARATIVE)

Application of Triclosan By Impregnation

In accordance with the only application method described within Swiss Patent 459,656, a textile was impregnated with triclosan and analyzed for its long-lasting antimicrobial properties.

Ultrafresh® NM, a 3% active triclosan dispersion available from Thomson Research Associates, Toronto, Canada, was diluted with water to 0.15% active triclosan content. The same fabric utilized on EXAMPLE 2 above was saturated with this solution and squeezed to about a 100% solution pick-up. The fabric was then immediately dried at 320° F. for 3 minutes in a convection oven. The treated fabric showed a 7 mm zone of inhibition and 100% contact inhibition when tested against *Staphylococcus aureus* using AATCC Test Method 147-1993. After 5 regular washing and drying laundry cycles, however, the fabric showed no zone of inhibition and 0% contact inhibition.

EXAMPLE 4

Application of Triclosan Acetate by Impregnation

In accordance with the only application method described within Swiss Patent 459,656, a textile was impregnated with triclosan ester, acetate, and analyzed for its long-lasting antimicrobial properties.

The same triclosan acetate dispersion as utilized in EXAMPLE 1 was diluted to 0.15% active ester content. The same polyester (polyethylene terephthalate) fabric utilized in EXAMPLE 2 was then saturated with the diluted solution and squeezed to about 100% solution pick-up. The fabric was immediately dried in a convection oven at 320° F. for 3 minutes. The treated fabric showed about a 4 mm zone of inhibition and 100% contact inhibition using AATCC Test Method 147-1993 against *Staphylococcus aureus*. After 5 regular washing and drying laundry cycles, the fabric showed no zone of inhibition and 0% contact inhibition.

There are, of course, many alternative embodiments and modifications of the present invention which are intended to be included within the spirit and scope of the following claims.

What I claim is:

1. A method of imparting long-lasting antimcrobial properties to a fabric comprising the sequential steps of (a) providing at least one triclosan ester derivative; and (b) contacting said triclosan ester derivative with a textile at a temperature and for a period of time sufficient to effectuate the diffusion of said triclosan ester derivative within the individual fibers of said textile;

wherein said textile comprises man-made fibers; and wherein the textile to triclosan ester derivative weight ratio is within the range of from about 100:0.03 to about 100:1.

2. The method of claim 1 wherein said triclosan ester derivative is selected from the group consisting essentially of a triclosan acetate, a triclosan propionate, a triclosan benzoate, a triclosan 4-nitrobenzoate, and a triclosan hexanoate.

3. The method of claim 2 wherein said triclosan ester derivative is a triclosan acetate.

4. The method of claim 1 wherein said textile is a fabric selected from the group consisting essentially of woven, non-woven, or knit fabrics.

5. The method of claim 1 wherein said man-made fibers are selected from the group consisting of polyester, polyamide, acetate, polyolefin, acrylic, lycra, and blends thereof.

6. The method of claim 5 wherein said man-made fibers are selected from the group consisting of polyester, polyamide, lycra, and blends thereof.

7. The process of claim 1 wherein the textile to triclosan ester derivative weight ratio is within the range of from about 100:0.1 to about 100:0.25.

8. The method of claim 1 wherein the temperature within step (b) is between about 80 and 130° C. and the period of time within step (b) is from about 10 to about 120 minutes in duration.

9. The process of claim 1 wherein, prior to step (a), said triclosan ester derivative is dispersed in water with a surfactant.

10. A method of imparting long-lasting antimicrobial properties to a fabric comprising the sequential steps of (a) providing a triclosan ester derivative;

(b) introducing said triclosan ester derivative into a dye bath wherein said dye bath contains at least one textile dyestuff;

(c) introducing a textile into said dye bath;

(d) agitating said dye bath and raising the temperature of said dye bath to a temperature and for a period of time sufficient to effectuate diffusion of said triclosan ester derivative and said dyestuff within the individual fibers of said textile; and (e) removing the textile from said dye bath;

wherein said textile comprises man-made fibers, and wherein the textile to triclosan ester derivative weight ratio is within the range of from about 100:0.03 to about 100:1.

11. The method of claim 10 wherein said triclosan ester derivative is selected from the group consisting essentially of a triclosan acetate, a triclosan propionate, a triclosan benzoate, a triclosan 4-nitrobenzoate, and a triclosan hexanoate.

12. The method of claim 11 wherein said triclosan ester derivative is a triclosan acetate.

13. The method of claim 10 wherein said textile is a fabric selected from the group consisting essentially of woven, non-woven, or knit fabrics.

14. The method of claim 13 wherein said man-made fibers are selected from the group consisting of polyester, polyamide, acetate, lycra, and blends thereof.

15. The method of claim 14 wherein said man-made fibers are selected from the group consisting of polyester, polyamide, lycra, and blends thereof.

16. The process of claim 10 wherein the textile to triclosan ester derivative weight ratio is within the range of from about 100:0.1 to about 100:0.25.

17. The method of claim 10 wherein the temperature within step (d) is between about 80 and 130° C. and the period of time within step (d) is from about 10 to about 120 minutes in duration.

* * * * *